US010385887B2

(12) United States Patent
Andersen et al.

(10) Patent No.: US 10,385,887 B2
(45) Date of Patent: Aug. 20, 2019

(54) HYDRAULIC MACHINE

(71) Applicant: Danfoss A/S, Nordborg (DK)

(72) Inventors: Stig Kildegaard Andersen, Krusaa (DK); Henry Madsen Møller, Sønderborg (DK); Palle Olsen, Nordborg (DK); Poul Erik Hansen, Aabenraa (DK)

(73) Assignee: Danfoss A/S, Nordborg (DK)

( * ) Notice: Subject to any disclaimer, the term of this patent is extended or adjusted under 35 U.S.C. 154(b) by 439 days.

(21) Appl. No.: 15/017,713

(22) Filed: Feb. 8, 2016

(65) Prior Publication Data

US 2016/0230788 A1 Aug. 11, 2016

(30) Foreign Application Priority Data

Feb. 11, 2015 (EP) ..... 15154610

(51) Int. Cl.
*F15B 15/14* (2006.01)
*F04B 1/10* (2006.01)
*F04B 1/20* (2006.01)

(52) U.S. Cl.
CPC ..... *F15B 15/1428* (2013.01); *F04B 1/10* (2013.01); *F04B 1/20* (2013.01); *F04B 1/2014* (2013.01); *F04B 1/2035* (2013.01); *F04B 1/2042* (2013.01)

(58) Field of Classification Search
CPC ..... F15B 15/1428; F04B 1/2014; F04B 1/10; F04B 1/20; F04B 1/2035; F04B 1/2042;
(Continued)

(56) References Cited

U.S. PATENT DOCUMENTS 3,680,987 A * 8/1972 Ohrberg ..... F01C 1/10 418/61.3
3,771,905 A * 11/1973 Ohrberg ..... F04C 2/104 137/625.21

(Continued)

FOREIGN PATENT DOCUMENTS

EP 1 001 166 A2 5/2000
EP 1 508 361 A1 2/2005

(Continued)

OTHER PUBLICATIONS

Wikipedia Webpage Enitiled "Pressure Exchanger" Dated Nov. 28, 2013, Accessed at https://en.wikipedia.org/w/index.php?title=Pressure_exchanger&oldid=583609441 on Oct. 2, 2018.

(Continued)

*Primary Examiner* — Devon C Kramer
*Assistant Examiner* — David N Brandt
(74) *Attorney, Agent, or Firm* — McCormick, Paulding & Huber LLP

(57) ABSTRACT

A hydraulic machine is provided comprising a cylinder unit (3) having a plurality of cylinders (4*a*, 4*b*) which are located on a circle line around an axis of rotation of said cylinder unit (3), a valve plate (6) located at an axial end of said cylinder unit (3) and having a through-going opening (8) for each cylinder (4*a*, 4*b*), and a port plate, said valve plate (6) and said port plate resting against each other in sliding contact at a contact face, wherein a pressure in each cylinder (4*a*, 4*b*) acts on a pressure area on a side of said valve plate (6) opposite said port plate. In such a hydraulic machine the risk of leaking should be kept small. To this end said pressure area (17) deviates from a circular form.

20 Claims, 3 Drawing Sheets

(58) Field of Classification Search
CPC ..... F04F 13/00; B10D 61/02; B10D 61/08; B10D 61/10; B10D 61/06; B10D 2313/246; C02F 1/44
See application file for complete search history.

(56) References Cited

U.S. PATENT DOCUMENTS 3,774,505 A * 11/1973 McLeod ..... F04B 1/20 91/506
3,799,201 A * 3/1974 Hansen ..... F01C 1/105 137/625.21
3,841,800 A * 10/1974 Ohrberg ..... F04C 2/104 418/61.3
3,905,728 A * 9/1975 Swedberg ..... F04C 2/104 418/149
4,004,866 A * 1/1977 Ohrberg ..... F04C 2/105 418/61.3
4,480,971 A * 11/1984 Swedberg ..... F04C 2/104 418/61.3
4,508,262 A * 4/1985 Pedersen ..... G05D 23/125 236/42
6,068,460 A * 5/2000 Haarstad ..... F04C 2/105 418/61.3
6,739,848 B1 * 5/2004 Hansen ..... F04C 2/104 137/625.21
9,341,063 B2 * 5/2016 Lucas ..... F01C 1/105
9,932,828 B2 * 4/2018 Iversen ..... F01B 3/0023
2004/0042910 A1 * 3/2004 Gleasman ..... F04B 1/126 417/269
2005/0226748 A1 * 10/2005 Gray, Jr. ..... F04B 1/2021 417/440
2012/0275928 A1 * 11/2012 Fritz ..... F04B 1/2035 417/53
2016/0130944 A1 * 5/2016 Iversen ..... F04B 1/2092 92/12.2
2016/0131116 A1 * 5/2016 Friedrichsen ..... F04B 11/005 417/521

FOREIGN PATENT DOCUMENTS

EP 1508361 A1 * 2/2005 ..... B01D 61/06
GB 1 324 756 7/1973
JP S56-038581 4/1981
JP S63-159678 A 7/1988
JP H04-241777 A 8/1992
JP H09-209918 A 8/1997

OTHER PUBLICATIONS

30 Second Intervals Captured from Video Provided at the webpage https://www.youtube.com/watch?v=J81mcTV7tUw, Published on Oct. 17, 2011.

* cited by examiner

HYDRAULIC MACHINE

CROSS REFERENCE TO RELATED APPLICATION

Applicant hereby claims foreign priority benefits under U.S.C. § 119 from European Patent Application No. EP15154610.8 filed on Feb. 11, 2015, the content of which is incorporated by reference herein.

TECHNICAL FIELD

The present invention relates to a hydraulic machine comprising a cylinder unit having a plurality of cylinders which are located on a circle around an axis of rotation of said cylinder unit, a valve plate located at an axial end of said cylinder unit and having a through-going opening for each cylinder, a port plate, said valve plate and said port plate resting against each other in sliding contact at a contact face, wherein a pressure in each cylinder acts on a pressure area on a side of said valve plate opposite said port plate.

BACKGROUND

An example for such a hydraulic machine is a pressure exchanger which is used in a reverse osmosis system.

Another example of such a hydraulic machine is an axial piston pump or an axial piston motor.

During operation of such a hydraulic machine the cylinder unit, which can be a cylinder block or a cylinder drum, rotates with respect to the port plate. The port plate usually has at least two kidney-shaped openings. In one of these kidney-shaped openings there is a low pressure and in the other one of the kidney-shaped openings is a high pressure. This high pressure acts on the side of the valve plate facing the port plate, i.e. the areas of the valve plate between the through-going openings. When the force generated by this high pressure and the area of the valve plate on which this high pressure acts is too high, the valve plate is lifted off the port plate and leakage occurs which should be avoided.

During operation of such a hydraulic machine approximately half of the cylinders are subjected to high internal pressure. This pressure acts on the pressure area pressing the valve plate against the port plate. However, in order to have as many cylinders as possible in the cylinder unit the cylinders are arranged closely side by side in circumferential direction. This limits the area on which the pressure within the cylinders can act. It is still possible that the force generated by the pressure in the high pressure kidney is larger than the force generated by the pressure in the high-pressure cylinders.

SUMMARY

The object underlying the invention is to make a small hydraulic machine.

This object is solved with a hydraulic machine as described at the outset in that said pressure area deviates from a circular form.

In this way it is possible to enlarge the pressure area without having the necessity to change the position of the cylinders. It is still possible to have a large number of cylinders thereby keeping a distance between cylinders in circumferential direction small. Since the pressure area deviates from the circular form it can be extended, for example radially to the inside or radially to the outside, to increase the pressure area. An increase of the pressure area increases the force generated by the pressure in the cylinder so that a better equilibrium between the force pressing the valve plate against the port plate and the force pressing the valve plate away from the port plate can be achieved.

In a preferred embodiment said port plate comprises at least a kidney-shaped opening having a radially inner border and a radially outer border and said pressure area extends radially beyond at least one of said borders. As mentioned above, in circumferential direction the cylinder and the corresponding through-going openings in the valve plates are closely neighboring so that it is not possible to extend the pressure area in circumferential direction over the maximum diameter of the through-going openings. However, in the radial direction there are less limitations so that it is possible to extend the pressure area in radial direction.

Additionally or alternatively it is preferred that said pressure area comprises in its radially outer half at least one enlargement in circumferential direction of said valve plate. When the valve plate is considered as a circle, there is one sector of this circle available for each cylinder and each through-going opening. This sector increases its width in circumferential direction viewed radially to the outside. This increase in width can be used to enlarge the pressure area, since this enlargement is located in the radially outer half of the pressure area.

In a particular preferred embodiment said pressure area has a wedge-like form. This wedge-like form is basically a triangle. It takes into account the above mentioned sector of the circular form of the valve plate.

Preferably said pressure area comprises outer border lines with a small curvature and rounded edges. The border lines can be straight lines or they can have a large radius. These border lines are connected to each other by rounded edges.

Preferably said pressure area is formed on a front face of a thrust pad, said front face being located on a side opposite to said valve plate. The thrust pad can be used to establish a connection between the valve plate and a cylinder. It is sufficient when the pressure in the cylinder acts on the thrust pad, and that the force generated by this pressure is transmitted to the valve plate by the respective thrust pad.

Preferably said thrust pad is in form of a member connected by form-fit with said valve plate. It is therefore not necessary to machine the valve plate itself. The thrust pad can be realized by a separate member which is assembled with the valve plate and held at the valve plate by form-fit. For example, the member can be an insert inserted at least partially into said valve plate.

In a preferred embodiment said member comprises a first part of round shape and a second part of polygonal form, said first part and said second part being assembled together. Such an embodiment is in particular useful when through-going openings have a circular form at least over a part of their length, since this part can be fabricated by drilling. The first part of round shape can be inserted into this drilled bore facilitating mounting of the member. The form of the second part can be chosen freely. The polygonal form is not limited to forms having straight edges. The polygonal form can have slightly curved borders and round edges as well.

Preferably said member is secured against rotation relative to said valve plate. This facilitates mounting.

Preferably a sealing zone sealing against an inside of a cylinder is formed at a circumferential face of said member. During mounting of the hydraulic machine the cylinders of the cylinder unit can easily be pushed onto the members to achieve a fluid tight connection between the cylinders and the through-going bores.

A preferred example of the invention will now be described in more detail with reference to the drawing, wherein:

DETAILED DESCRIPTION

Figure 1:
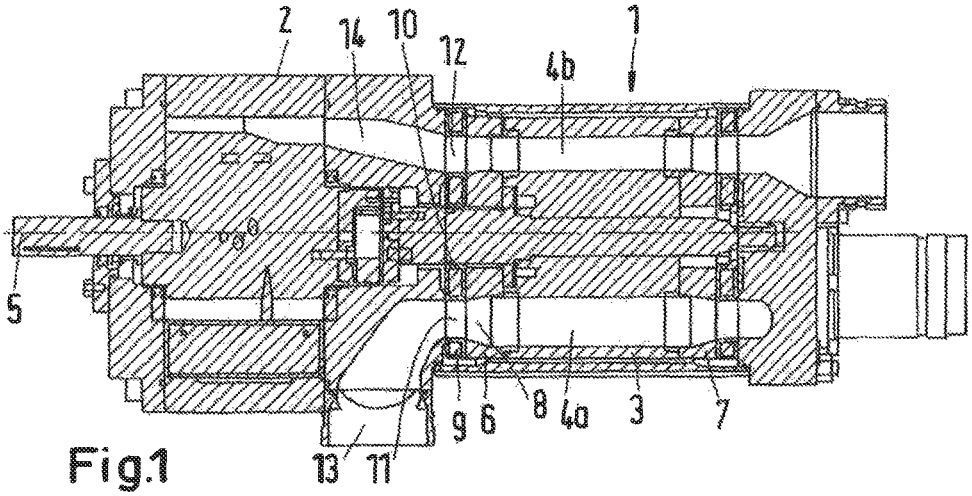
FIG. 1 shows a longitudinal sectional view of a hydraulic machine.

FIG. 1 shows schematically in longitudinal section a hydraulic machine 1 in form of pressure exchanger which is connected to a vane cell pump 2.

The hydraulic machine 1 comprises a cylinder unit 3, e.g. a cylinder drum, having a plurality of cylinders 4*a*, 4*b*. Only cylinder 4*a* is cut along its longitudinal middle axis. The cylinders 4*a*, 4*b* are arranged on a circle around an axis 5 of rotation.

A valve plate 6 is located at an end of the cylinder unit 3 on the side facing the vane cell pump 2. A corresponding valve plate 7 is located at the opposite side. The following description focuses on the first named valve plate 6. However, it is clear that the same construction can be used in connection with the other valve plate 7.

The valve plate 6 has a through-going opening 8 for each cylinder 4*a*, 4*b*.

Figure 8:
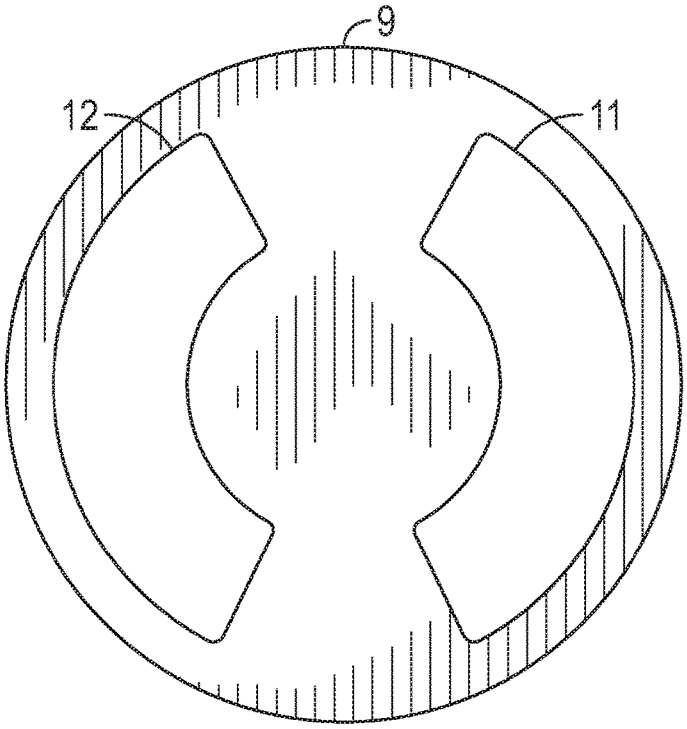
FIG. 8 shows a port plate according to the invention.

Furthermore, a port plate 9 is provided. The valve plate 6 rests against the port plate 9 in sliding contact at a contact face 10. As shown in FIG. 8, the port plate 9 comprises two kidney-shaped openings 11, 12. The first opening 11 is connected with a low pressure input 13. The second kidney-opening 12 is connected to the high pressure output 14 connecting the hydraulic machine 1 and the vane cell pump 2. The vane cell pump 2 serves as booster pump increasing the pressure of the high pressure output 14 to a higher pressure level.

When the cylinder unit 3 rotates, the pressure in the high pressure opening 12 acts on the valve plate 6 in areas between the openings 8. This pressure generates a force tending to lift the valve plate 6 off the port plate 9. This causes the risk of a leakage which should be avoided.

To avoid or at least reduce this risk, the valve plate 6 has, for each cylinder 4*a*, 4*b*, a thrust pad 15 of a wedge-like or triangular form. The cylinder unit 3 has, for each cylinder 4*a*, a corresponding recess 16 in which the thrust pad 15 can be inserted. The thrust pad 15 forms at its front face a pressure area 17 deviating from a circular form. More precisely the pressure area extends radially beyond the radially inner border of the kidney-shaped openings 11, 12. Additionally, it is possible that the pressure area 17 extends radially outwardly beyond the radially outer border of the kidney-shaped openings 11, 12. However, in most cases it will be sufficient that the pressure area is extended to the radial inside of the valve plate 6.

Figure 2:
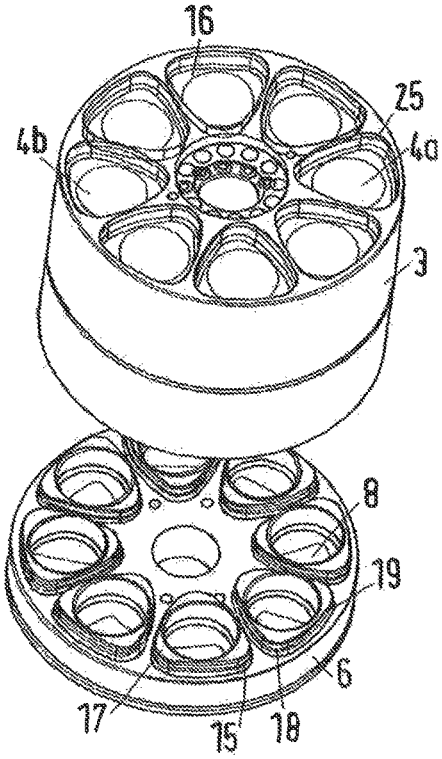
FIG. 2 shows an exploded perspective view of a cylinder unit.
Figure 3:
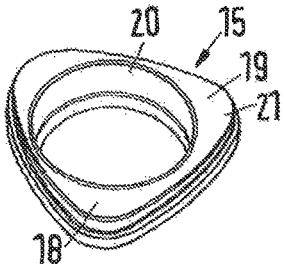
FIG. 3 shows a perspective view of a thrust pad.

Furthermore, as can be seen in FIGS. 2 and 3, the thrust pad 15 comprises in its radially outer half two enlargements 18, 19 in circumferential direction of said valve plate 6.

It can be imagined that the cylinder unit 3 is divided in sectors, one sector for each cylinder 4*a*. The form of the thrust pad 15 and therefore the form of the pressure area now makes use of the form of such a sector taking into account that the width of the sector in circumferential direction increases with increasing radius.

The pressure area 17 therefore can be made larger so that the pressure within a cylinder 4*a*, 4*b* is sufficient to generate a force when multiplied with the pressure area 17 which balances out the force generated by the pressure in the high pressure kidney-shaped opening 12.

Figure 4:
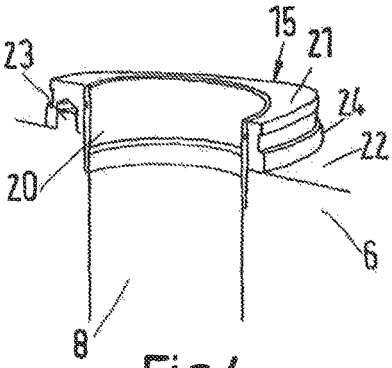
FIG. 4 shows a partly sectional view of the thrust pad of FIG. 3.

As can be seen in FIGS. 3 and 4, the thrust pad 15 is in form of a member separate from the valve plate 6 and connected to said valve plate by form-fit.

To this end the thrust pad 15 comprises a first part 20 which is of round shape or ring shape and a second part 21 of polygonal form. The first part 20 and the second part 21 are assembled together. The thrust pad 15 can be inserted into bore 8 with the first part 20. The second part 21 rests on a surface 22 of the valve plate 6 opposite to the port plate 9. Assembling of the two parts 20, 21 can take place prior, during or after mounting the first part 20 to the valve plate 6.

A protrusion 23 is provided on the surface 22 protruding into second part 21 and securing the member against rotation relative to the valve plate 6.

The second part 21 comprises a circumferential face 24 which forms a sealing zone 26 acting against an inside 25 of the recess 16 of each cylinder 4*a* when the cylinder unit 3 and the valve plate 6 are assembled.

It can be seen in FIGS. 2 and 3 that the thrust pad 15 has a wedge-like or triangular form. The circumferential face 24 is formed by three basically straight sections connected by rounded edges. The basically straight edges can be formed by straight lines or they can be slightly curved, i.e. they have a large radius of curvature. A certain curvature is preferred since this facilitates the sealing of the member against the inside 25 of the recess 16.

Figure 5:
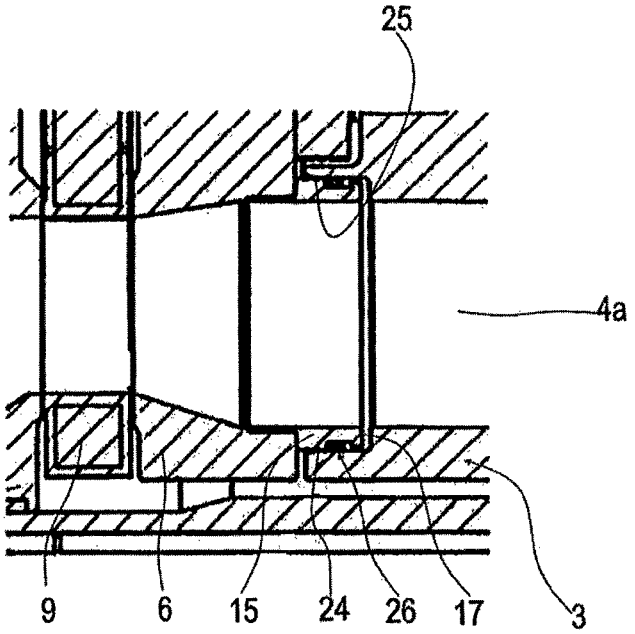
FIG. 5 shows a sectional view of an end of a cylinder.

FIG. 5 schematically shows an enlarged sectional view of an end of cylinder 4*a*. The thrust pad 15 is inserted into the cylinder unit 3. The circumferential face 24 of the thrust pad 15 together with the inside 25 of the recess 16 form a sealing zone 26. Therefore, the pressure within cylinder 4*a* can act on the pressure area 17 of the thrust pad 15.

Figure 6:
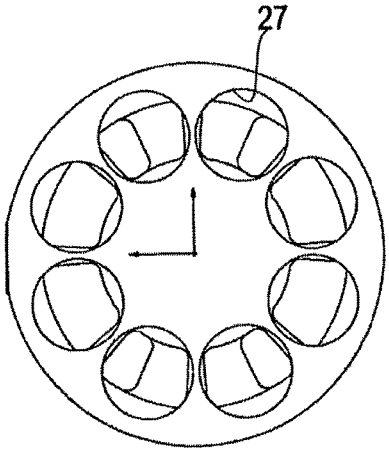
Prior Art Fig. 6
FIG. 6 shows a schematically view of circular thrust pads.
Figure 7:
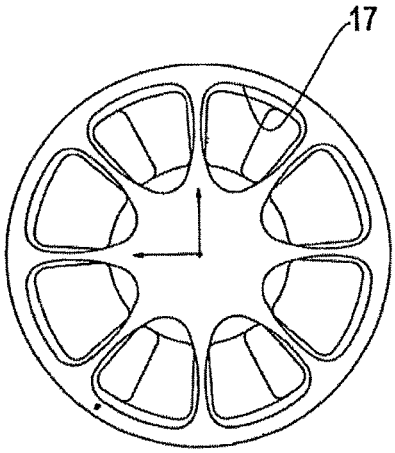
FIG. 7 shows a schematically view of thrust pads according to the invention.

A comparison of FIGS. 6 and 7 shows the enlargement of the effective pressure area. FIG. 6 shows the conventional form in which the pressure areas are formed by a circle 27. FIG. 7 shows the new form of the pressure areas 17. It can easily be seen that the new form of the pressure area 17 is larger than just a circle. However, the same number of pressure areas 17 can be arranged on the same diameter as before.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic machine comprising a cylinder unit having a plurality of cylinders which are located on a circle around an axis of rotation of said cylinder unit, a valve plate located at an axial end of said cylinder unit and having a through-going opening for each cylinder, a port plate, said valve plate and said port plate resting against each other in sliding contact at a contact face, and a thrust pad for each cylinder forming a pressure area acting on a side of said valve plate opposite said port plate, wherein a pressure in each cylinder acts on the pressure area of each corresponding thrust pad, wherein said pressure area deviates from a circular form, wherein a portion of each thrust pad defines a thrust pad portion area which is larger than the area within a plane oriented in a radial direction from the axis of rotation at the through-going opening, and wherein said portion of each thrust pad portion area of each thrust pad is fluidly connected to said cylinder area of each corresponding cylinder.

2. The hydraulic machine according to claim 1, wherein said port plate comprises at least a kidney-shaped opening having a radially inner border and a radially outer border and said pressure area extends radially beyond at least one of said borders.

3. The hydraulic machine according to claim 1, wherein said pressure area comprises in its radially outer half at least one enlargement in circumferential direction of said valve plate.

4. The hydraulic machine according to claim 1, wherein said pressure area has a wedge form.

5. The hydraulic machine according to claim 1, wherein said pressure area comprises outer border lines with a small curvature and rounded edges.

6. The hydraulic machine according to claim 1, wherein said thrust pad is in form of a member connected by form-fit to said valve plate.

7. The hydraulic machine according to claim 6, wherein said member comprises a first part of round shape and a second part of polygonal form, said first part and said second part being assembled together.

8. The hydraulic machine according to claim 6, wherein said member is secured against rotation relative to said valve plate.

9. The hydraulic machine according to claim 6, wherein a sealing zone sealing against an inside of one cylinder of the plurality of cylinders is formed at a circumferential wall of said member.

10. The hydraulic machine according to claim 2, wherein said pressure area comprises in its radially outer half at least one enlargement in circumferential direction of said valve plate.

11. The hydraulic machine according to claim 2, wherein said pressure area has a wedge form.

12. The hydraulic machine according to claim 3, wherein said pressure area has a wedge form.

13. The hydraulic machine according to claim 2, wherein said pressure area comprises outer border lines with a small curvature and rounded edges.

14. The hydraulic machine according to claim 3, wherein said pressure area comprises outer border lines with a small curvature and rounded edges.

15. The hydraulic machine according to claim 4, wherein said pressure area comprises outer border lines with a small curvature and rounded edges.

16. The hydraulic machine according to claim 2, wherein said pressure area is formed on a front face of one thrust pad of the thrust pad for each cylinder, said front face being located on a side opposite to said valve plate.

17. The hydraulic machine according to claim 3, wherein said pressure area is formed on a front face of one thrust pad of the thrust pad for each cylinder, said front face being located on a side opposite to said valve plate.

18. The hydraulic machine according to claim 4, wherein said pressure area is formed on a front face of one thrust pad of the thrust pad for each cylinder, said front face being located on a side opposite to said valve plate.

19. The hydraulic machine according to claim 5, wherein said pressure area is formed on a front face of one thrust pad of the thrust pad for each cylinder, said front face being located on a side opposite to said valve plate.

20. The hydraulic machine according to claim 1, wherein each thrust pad is configured such that fluid pressure at said portion of each thrust pad forces the valve plate towards the port plate.

* * * * *